US006025813A

United States Patent [19]

Hately et al.

[11] Patent Number: 6,025,813

[45] Date of Patent: Feb. 15, 2000

[54] RADIO ANTENNA

[76] Inventors: Maurice Clifford Hately, 1 Kenfield Place, Aberdeen, AB15 7UW, United Kingdom; Fathi Mohammed Kabbary, Flat 15, 2 Okasha Street, Dokki, Cairo 12311, Egypt

[21] Appl. No.: 09/144,044

[22] Filed: Aug. 31, 1998

[30] Foreign Application Priority Data

Aug. 30, 1997 [GB] United Kingdom ..... 9718311

[51] Int. Cl.[7] ..... H01Q 11/12

[52] U.S. Cl. ..... 343/867; 343/741; 343/744; 343/853

[58] Field of Search ..... 343/741, 742, 343/744, 745, 750, 752, 850, 853, 866, 867, 868, 870; H01Q 11/12

[56] References Cited

U.S. PATENT DOCUMENTS 5,530,453 6/1996 Koyama ..... 343/718

5,826,178 10/1998 Owen ..... 455/193.1

*Primary Examiner*—Hoanganh Le
*Assistant Examiner*—Shih-Chao Chen
*Attorney, Agent, or Firm*—Horst M. Kasper

[57] ABSTRACT

A radio antenna system comprises a single low impedance feed socket coupled to a junction point splitting the feeder power into two separate circuits each of which passes approximately half the feed input power around a respective one of two conductors insulated from each other and in close proximity over their lengths and forming a dual loop not more than ten per cent of the operating wavelength in circumference at the lowest frequency to be radiated, the power flowing in opposite directions around each loop and having approximately plus and minus 45 degrees electrical phase difference produced by two series capacitors, the one being ahead of the first conductor, and the other being after the second conductor, the said conductors of the loop being in sufficiently close proximity to provide interaction of the fields through Poynting vector synthesis.

12 Claims, 4 Drawing Sheets

RADIO ANTENNA

BACKGROUND OF THE INVENTION

1. Field of the Invention

This invention relates to a radio antenna. With the miniaturisation of electronic equipment for telecommunications it has become desirable to develop correspondingly small yet efficient radio antennas. This has been achieved by using reactive tuned forms of conventional wire antennas, but these have restricted bandwidths and reduced efficiency. It is the object of this invention to provide an antenna system which has improved operational efficiency and which has wideband characteristics.

2. Description of the Prior Art

This invention uses the Poynting Vector Synthesis, such as disclosed in GB 2 215 524 and U.S. Pat. No. 5,155,495, in which the antennas create radiation from out of phase voltages applied to a conductor plate and either a coil, or a second plate. Electric and magnetic fields are made to cross each other at right angles with a precise amount of out-of-phase in the cycle. In the present invention the same principles are used, but instead of two out-of-phase voltages being applied to plates, out-of-phase currents are used in closely spaced wire conductors.

It is the presently accepted view that a radio wave may be imagined theoretically as consisting of a pair of transverse alternating fields, one electrical and one magnetic, travelling in phase at the velocity of light, geometrically orthogonal and absolutely synchronous. When examined at a great distance from their source the said fields are an almost perfect plane wave as shown in the drawings illustrating two partial representations:

FIG. 1 shows the plane wave as a Poynting Vector. E is the radio frequency electric field, units Volts per metre; H is the radio frequency magnetic field, units Amp-turns per metre; S is the vector representing outward power-flow density and is in units of Watts per square metre. Mathematically S is the vector cross product of the electric field with the magnetic field, written in terminology of vector maths: $S=E\times H$. Exactly half the power is in each field, and their magnitude relationship being set by the natural space impedance Zo given by: $Zo=|E|/|H|$ FIG. 2 shows the waveform phase relationships of the components of the Poynting Vector for the plane wave as a time function.

SUMMARY OF THE INVENTION

It was proposed that in order to create a small but efficient radio antenna it should be possible to create an RF electric field with half the power, and launch the energy as a travelling radio wave by acceleration. In such a system the electric field is accelerated by an intimate in-phase disturbance comprising the remaining half power originating an RF magnetic field cutting across the electric field lines at right angles.

According to this invention there is provided a radio antenna system comprising a single junction point splitting the power fed thereto from a low impedance feeder connected to two separate circuits each of which passes approximately half the feed input power around a respective one of two conductors insulated from each other and in close proximity over their lengths and forming a dual loop not more than ten per cent of the operating wavelength in circumference at the lowest frequency to be radiated, the power flowing in opposite directions around each loop and having approximately plus and minus 45 degrees electrical phase difference produced by two series capacitors, the one being ahead of the first conductor, and the other being after the second conductor, the said conductors of the loop being in sufficiently close proximity to provide interaction of the fields.

The spacing between the loops is of a dimension which is insignificant with respect to the wavelength of operation.

In this way and by such means the fields can interact in accordance with the Poynting Theorem, to create radio waves from the two half powers.

There are two main features which differentiate this invention from the prior art; the one being the phasing unit in the antenna head itself and the other being the monoband nature of the phasing due to the resonant components off tune.

Preferably the antenna system has the one conductor comprising a conducting tube carrying the other conductor within and forming a coaxial construction.

The antenna system may be used in combination with passive and resonant conducting elements arranged to preferentially direct radio waves in a selected direction.

In an embodiment the loop is located at the focus of a reflecting surface being preferably a parabolic dish.

Two inductors may be incorporated, the one connected after one conductor and the other connected before the other inductor.

An inductor can be connected either after the first loop conductor or before the second loop conductor the said two inductors preferably having a degree of mutual coupling and forming a radio frequency transformer.

In the antenna system in accordance with this invention the said capacitors may be made variable either manually or by a control device actuated remotely and in particular the capacitors can be controlled to match the feeder system or to optimise the system for radiation efficiency.

A radio antenna system in accordance with this invention may have a plurality of loops fed from a common source and arranged in spatial relationship to form an array.

The antenna system can comprise two loop conductors with two out of phase currents provided by the outputs of two separate amplifier means with the inputs thereof excited by very low power signals phased by circuits with low power passive components. This arrangement is particularly suitable for low power (milliwatt) systems.

The antenna system in accordance with this invention can be fabricated using printed circuit techniques and incorporated into a circuit board, smart card, sales system, computer or silicon chip.

BRIEF DESCRIPTION OF THE DRAWINGS

This invention is further described and illustrated with reference to the accompanying drawings, wherein.

DESCRIPTION OF PREFERRED EMBODIMENTS

Figure 1:
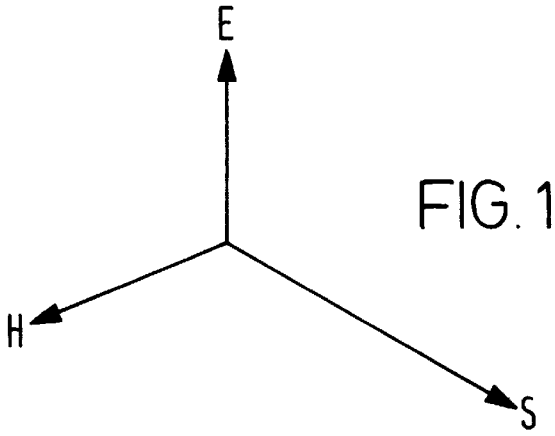
FIG. 1 shows a plane wave as a Poynting Vector.
Figure 2:
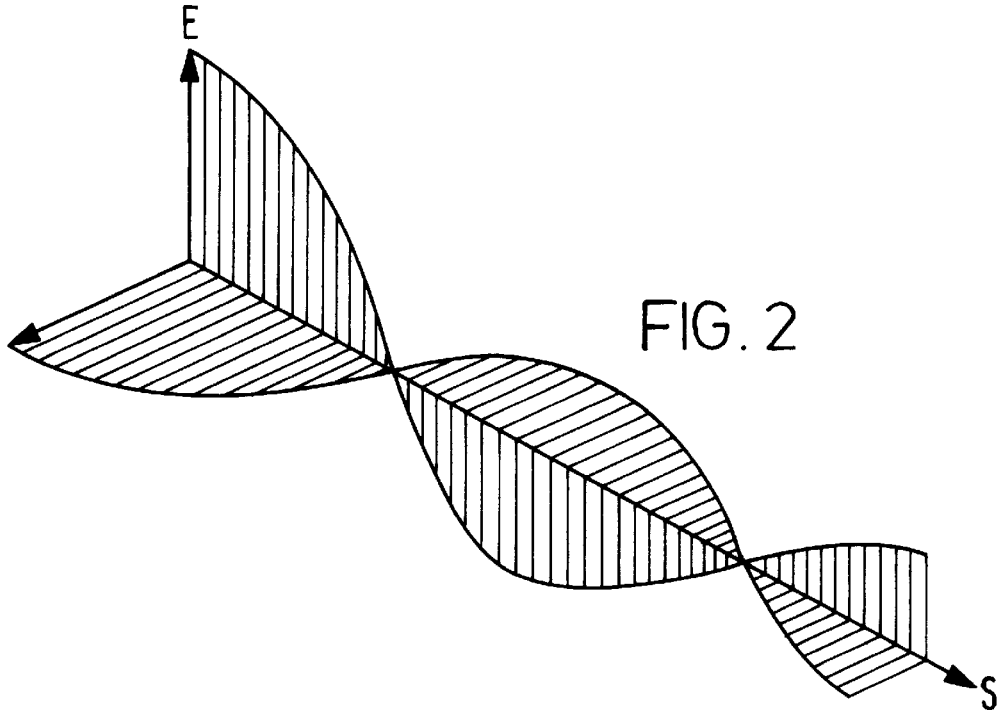
FIG. 2 shows the phase relationship of the Poynting Vector for the plane wave of FIG. 1.
Figure 3:
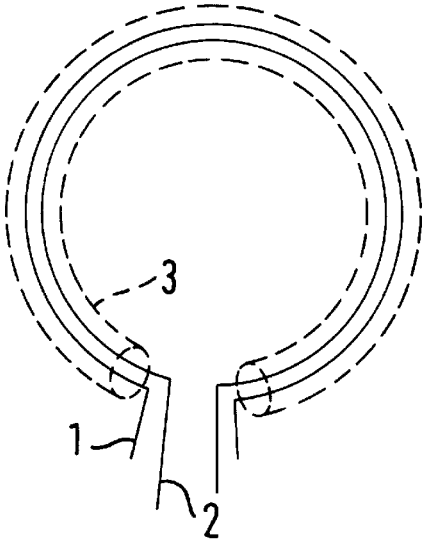
FIG. 3 shows the basic arrangement of a dual loop antenna according to this invention.

The basic arrangement of the Dual Loop Radio Antenna according to this invention is shown as a partial plan view in FIG. 3. Conductor 1 and conductor 2 are closely located but insulated from each other and their environment by a low-loss insulation material 3. They are typically less than ten per cent of the operating wavelength. The electric field E is originated on free charges on the surface of conductor 1, and the magnetic field H to accelerate the charges is created by the current flowing in conductor 2.

Figure 4:
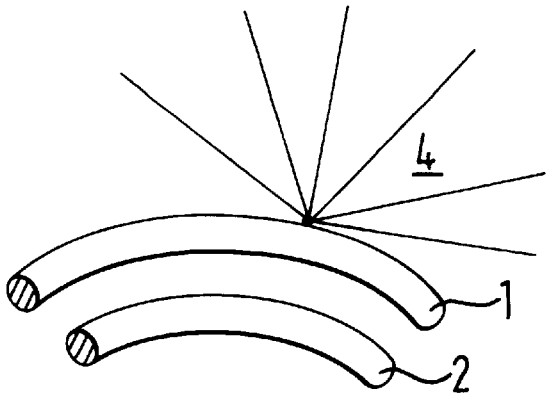
FIGS. 4 and 5 show schematically an enlarged sketch of the electric field and current interaction.
Figure 5:
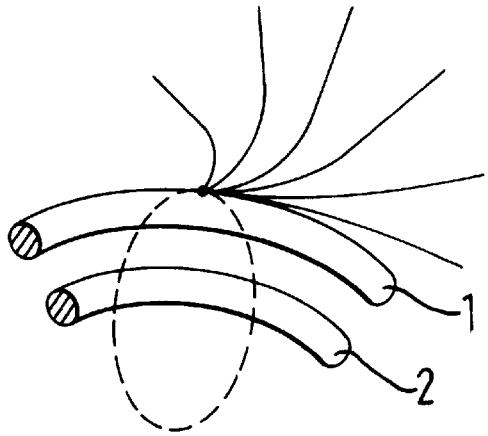

FIGS. 4 and 5 show an idealised theoretical small charge system of the antenna. A few of the electric field lines surrounding a small free charge 4 are shown in the enlarged sketch of a small part of conductor 1 of the antenna. When the current is maximum in the nearby conductor 2, the magnetic field lines from it cut across the electric field lines of the said charges, and accelerate them. Conceptually where the acceleration occurs there is accompanying distortion of the electric field line, since both effects are travelling at the velocity of light and repeating distortion of the electric field lines is a well documented prime cause of radio wave production.

The operation of the antennas disclosed in the prior-art referred to in the earlier patents have confirmed the Poynting Theorem as extended to apply to radio frequencies which requires that for radio wave generation, the electrical phase difference of the two fields must be exactly zero. However, the electric lines are at a maximum when the voltage on the conductor 1 is at maximum voltage (and zero current), whereas the magnetic field lines linking the wires are at maximum when the current flow in the conductor 2 is maximum. In other words, if the fields were to be obtained from a single source of current, their effects would be 90 degrees out of phase, and the radio wave would not be created.

Figure 6:
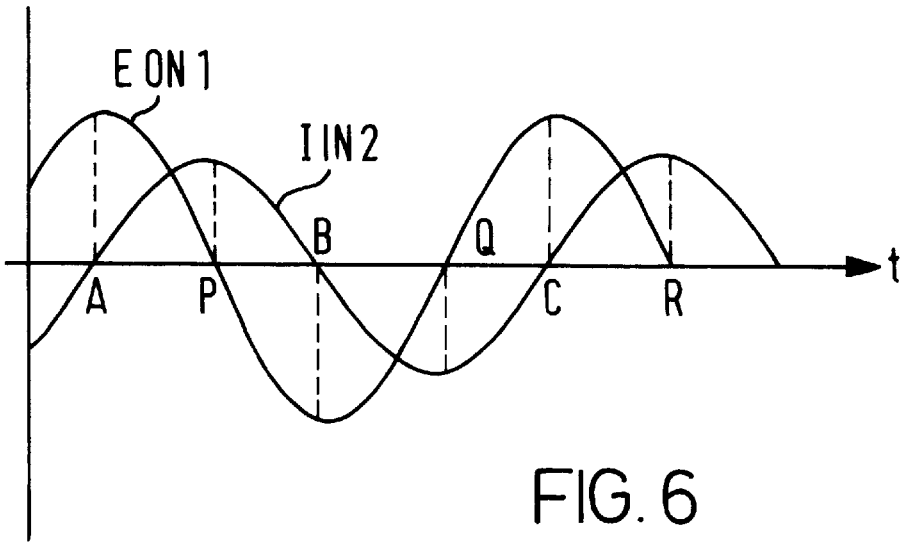
FIG. 6 shows the voltage-current relationships during the full RF cycle.

FIG. 6 shows the voltage and current relationships during a full RF cycle. At times in the cycle marked as A,B,C, . . . peaks of energy emanate from conductor 1. At times P,Q, R, . . . peaks of energy emanate from conductor 2. The field vector relationships for Poynting Vector Synthesis will only be correct (both peaks synchronised) if there is arranged an appropriate phase difference of 90 degrees in the two source currents in the loops. The energy flow of the radio wave components E and H are seen to be synchronous and correctly rotated if the current on the conductor 2 is 90 degrees ahead of that of the current in conductor 1, and the current directions are as in FIG. 5. As the RF alternating current cycles progress, the fields interact and radio wave energy flows outwards from the system omnidirectionally. Power is drawn from the split point into each conductor so resistive impedance appears to be implanted in each of the conductors.

Looked at from the viewpoint of Quantum Mechanics, virtual photons of the electric field and virtual photons of the magnetic field, (both only having half spin and a short lifetime), collide and interact to form real (radio frequency) photons with a spin of one, and infinite lifetime, which possess the independence to travel away into space at the velocity of light.

Figure 7:
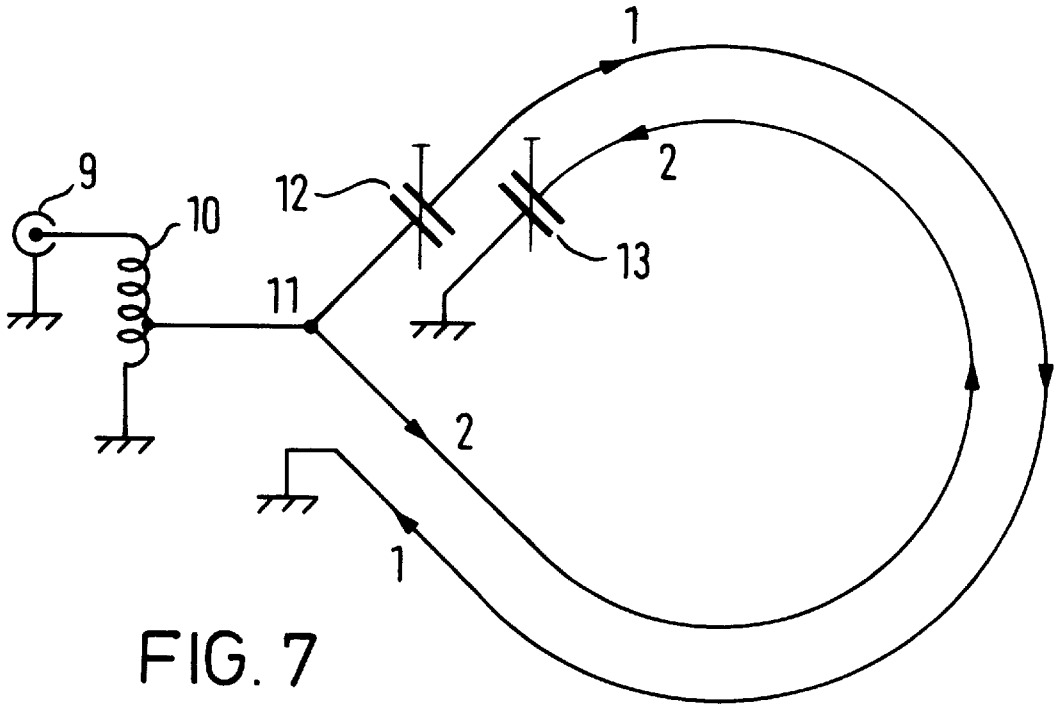
FIG. 7 shows a circuit diagram of the antenna system of this invention.

In practice, the necessary total 90 degrees phase difference between the currents can be obtained by providing 45 degrees phase advance in one wire conductor, and 45 degrees delay in the other conductor using just two capacitors. The circuit diagram of such an arrangement is given in FIG. 7. The power to be radiated is fed at socket 9 via a coaxial feeder (not shown) from a transmitter. The auto transformer 10 changes the impedance from the feeder impedance to the impedance appropriate for the dual conductor loop, placing the radio frequency current at the division point 11, and feeds all return currents to the socket-outer return connection. At the division or splitting point, current division occurs. Approximately half of the current flows clockwise around conductor 1 with a phase advance, since it flows firstly through adjustable capacitor 12 and then through the inductive loop to the common return. Whereas the other approximate half current flows anticlockwise via inductive conductor 2, and then through capacitor 13 to the common return. The two loop conductors and their adjustable capacitors constitute series resonant circuits. They are carefully adjusted, at the carrier frequency to be radiated, to be 45 degrees ahead of resonance, and 45 degrees behind resonance, and when this is confirmed, Poynting Vector Synthesis occurs and both resonant circuits lose power to radiated space waves, and develop resistive damping and draw significant currents from the division point. As a result of the above in a complementary way, the two extended series resonant circuits have non-congruent part-conductors lying together constituting a field interaction zone lying around most of the loop circumference.

Figure 8:
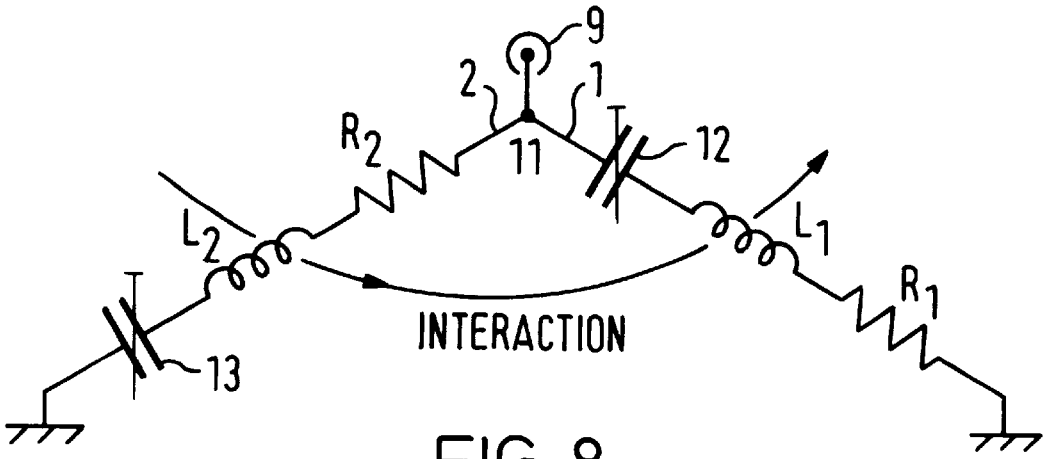
FIG. 8 shows the equivalent circuit of FIG. 7.

FIG. 8 shows the equivalent circuit when the dual loop antenna is working in this way. The conductor 1 is now represented by a lumped inductance L1 and induced damping resistance R1; conductor 2 as lumped inductance L2 with induced damping resistor R2. The curved arrow linking the two sides is marked INTERACTION to represent the working mode of the antenna.

Figure 9:
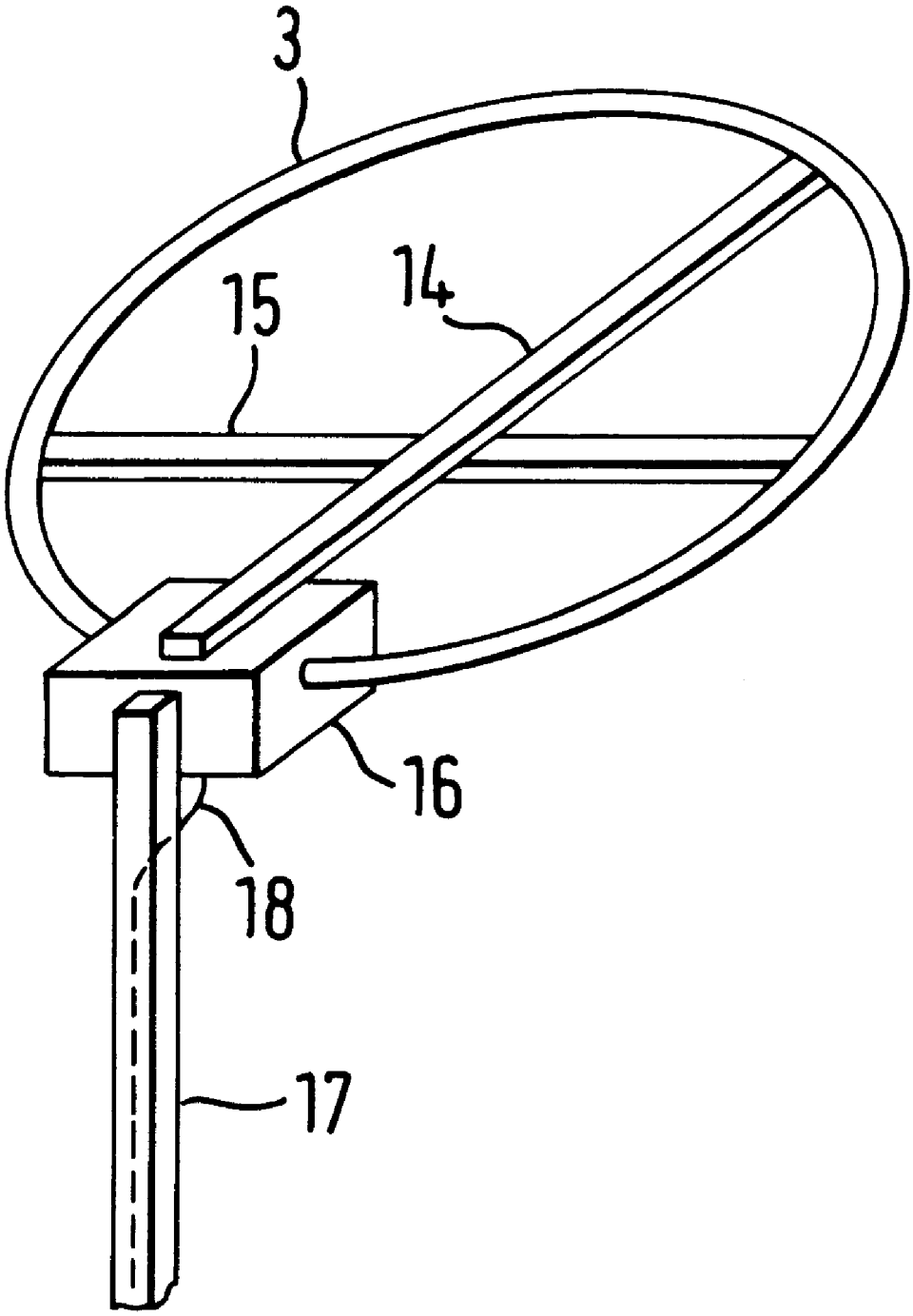
FIG. 9 shows a practical embodiment of antenna according to this invention.

FIG. 9 shows the practical construction of a functional dual loop radio antenna. The circular insulating conductor housing 3 (shown in FIG. 3) is held by cross bracing struts 14 and 15, with the phasing capacitors contained within a protective insulating box 16, supported on an aerial mast (not shown) by means of a hollow insulating leg 17, within which the coaxial feeder 18 may be located.

The optimum size for the loop antenna is approximately 1.5% of the wavelength in diameter, that is approximately one sixty-fifth of a wavelength in size of 5% lambda circumferential length. The spacing between the conductors can be as small as is desired, generally the closer the better. A typical loop which efficiently radiated 14 MHz is 32 centimetres diameter, and the wire spacing was 1 millimetre. The Dual Loop Radio Antenna supported horizontally above its surroundings, emits vertically polarised waves in all horizontal directions.

The plane-wave view of the Poynting Vector is simplistic because it does not represent the inherent property of a radio wave system to enlarge, and fill space, as it travels outwards from its source as a spherical shaped wavefront. In practice, near to any radiating antenna, there is considerable curvature to the two constituent fields. For the dual loop radio antenna, the necessary curved shapes of the fields are provided by the recommended circuit proportions and layout described.

With high quality components, this type of antenna exhibits excellent radiation efficiency on transmit, and very large signals are captured when used in receive. It is an extremely useful antenna for mobile radio communications. The instantaneous bandwidth is typically 1.7% between frequencies with SWR less than 1.5 to 1, with the autotransformer suitably designed. Adjustment bandwidths of 300% have been achieved. The antenna is useful for radio communications in circumstances having a site or a platform size restriction.

We claim:

1. A radio antenna system comprising a single junction point splitting the power fed thereto from a low impedance feeder connected to two separate circuits each of which passes approximately half the feed input power around a respective one of two conductors insulated from each other and in close proximity over their lengths and forming a dual loop not more than ten per cent of the operating wavelength in circumference at the lowest frequency to be radiated, the power flowing in opposite directions around each loop and having approximately plus and minus 45 degrees electrical phase difference produced by two series capacitors, the one being ahead of a first conductor, and the other being after a second conductor, said conductors of the loop being in sufficiently close proximity to provide interaction of the fields.

2. A radio antenna system as claimed in claim 1, in which the one conductor comprises a conducting tube carrying the other conductor within and forming a coaxial construction.

3. A radio antenna system as claimed in claim 1, in combination with passive and resonant conducting elements arranged to preferentially direct radio waves in a selected direction.

4. A radio antenna system as claimed in claim 1, wherein the loop is located at the focus of a reflecting surface being preferably a parabolic dish.

5. An antenna system in accordance with claim 1, wherein two inductors are incorporated, the one connected after one conductor and the other connected before the other inductor.

6. An antenna system in accordance with claim 1, wherein an inductor is connected either after the first loop conductor or before the second loop conductor.

7. An antenna system in accordance with claim 5, wherein the said two inductors have a degree of mutual coupling and forming a radio frequency transformer.

8. An antenna system in accordance with claim 1, wherein the said capacitors are variable either manually or by a control device actuated remotely.

9. An antenna system in accordance with claim 8, wherein the capacitors are controlled to match the feeder system or to optimise the system for radiation efficiency.

10. A radio antenna system in accordance with claim 1, comprising a plurality of loops fed from a common source and arranged in spatial relationship to form an array.

11. An antenna system according to claim 1, and comprising two loop conductors with two out of phase currents provided by the outputs of two separate amplifier means with the inputs thereof excited by signals phased by circuits with low power passive components.

12. An antenna system in accordance with claim 1, fabricated using printed circuit techniques and incorporated into a circuit board, smart card, sales system, computer or silicon chip.

* * * * *